United States Patent [19]

Patella et al.

[11] 4,283,054

[45] Aug. 11, 1981

[54] DISK GAME APPARATUS

[76] Inventors: Gianfranco Patella, 4A/8, Via di Serretto; Luciano Patella, 18/6, Corso Italia, both of Genoa, Italy

[21] Appl. No.: 76,933

[22] Filed: Sep. 19, 1979

[30] Foreign Application Priority Data

Sep. 19, 1978 [IT] Italy ..... 15254 B/78

[51] Int. Cl.[3] ..... A63F 3/00

[52] U.S. Cl. ..... 273/126 R; 273/128 R

[58] Field of Search ..... 273/126 R, 126 A, 85 R, 273/59 R, 14, 128 R, 128 CS

[56] References Cited

U.S. PATENT DOCUMENTS

| | | | |
|---|---|---|---|
| 715,796 | 12/1902 | Haskell | 273/126 R |
| 800,232 | 9/1905 | McCluskey | 273/126 R |
| 1,368,401 | 2/1921 | Kettle | 273/126 R |
| 3,533,626 | 10/1970 | Smith | 273/126 R |
| 3,610,625 | 10/1971 | Erno | 273/126 R |
| 3,704,887 | 12/1972 | Thornton | 273/14 |
| 3,825,258 | 7/1974 | Frierman | 273/14 |
| 3,993,305 | 11/1976 | Nicholson | 273/59 R |

*Primary Examiner*—Richard C. Pinkham
*Assistant Examiner*—T. Brown
*Attorney, Agent, or Firm*—Berman, Aisenberg & Platt

[57] ABSTRACT

A game for playing on a flat surface having a smooth sliding surface and generally cylindrical disks which slide on the playing surface. On the bottom side of the disk are a plurality of small circular projections each terminating in a concave imprint with the concavity directed downwardly. Centrally located in the central projection is a point projecting beyond the outside edge of the concave imprint. The disk contacts and slides on the playing surface of the point and the circular edges of the concave imprints.

3 Claims, 6 Drawing Figures

DISK GAME APPARATUS

FIELD OF THE INVENTION

The disclosed invention relates to a playing board and playing pieces for sliding across the surface of the playing board to knock other pieces of the game into playing board pockets for scoring.

SUMMARY OF THE INVENTION

The present invention relates to a table game, and more particularly to a table game of the type comprising a flat playing area presenting a smooth sliding surface onto which there can slide disks impelled by the players. The playing area is preferably rectangular, and it is delimited by four longitudinal ledges serving as cushions, so that the disks, impelled by the players, may strike and rebound from the ledges and against one another. Also, preferably, the playing area presents in its corners, pockets which are capable of receiving the sliding disks, in the same manner as the pockets provided in a billiards table. Depending on the type of game, the playing area will be provided with suitable markings, such as lines, circles and dots.

Accordingly, the disks (which are usually made of hard plastic) present on their bottom side, which is the side intended to come into contact with the sliding surface of the playing area, a plurality of orderly arranged circular projections, each projection terminating with a concave imprint with the concavity directed downwardly, so that the actual contact between the bottom side of each disk and the sliding surface is substantially established by the circular edges of the concave imprints. By this arrangement, it has been found that the friction of the disks moving on the sliding surface is greatly reduced, and therefore the said disks will slide more quickly and easily with reduced consumption both of the disks and of the sliding surface.

According to another characterizing feature of the invention, it has been found that the friction between the disks and the sliding surface can be further reduced, by providing, in the projection located at the center of the disk, a point which projects slightly beyond the plane defined by the circular edge of the concavity of the said projection.

Still according to another feature of the invention, the sliding surface of the playing area is obtained by coating the playing area with a hard, smooth, transparent plastic material. In this manner, while the markings provided on the playing area are visible, they are protected from the wear due to the disks sliding thereon, and by suitably choosing the type of plastic coating, the coefficient of friction between the disks and the sliding surface can be further reduced.

The above and other features of the invention, and the advantages deriving therefrom, will appear evident from the following detailed description of a preferred embodiment, made with reference to the attached drawings.

DESCRIPTION OF THE PREFERRED EMBODIMENT

Figures 1, 2, 3, 4, 5, 6:
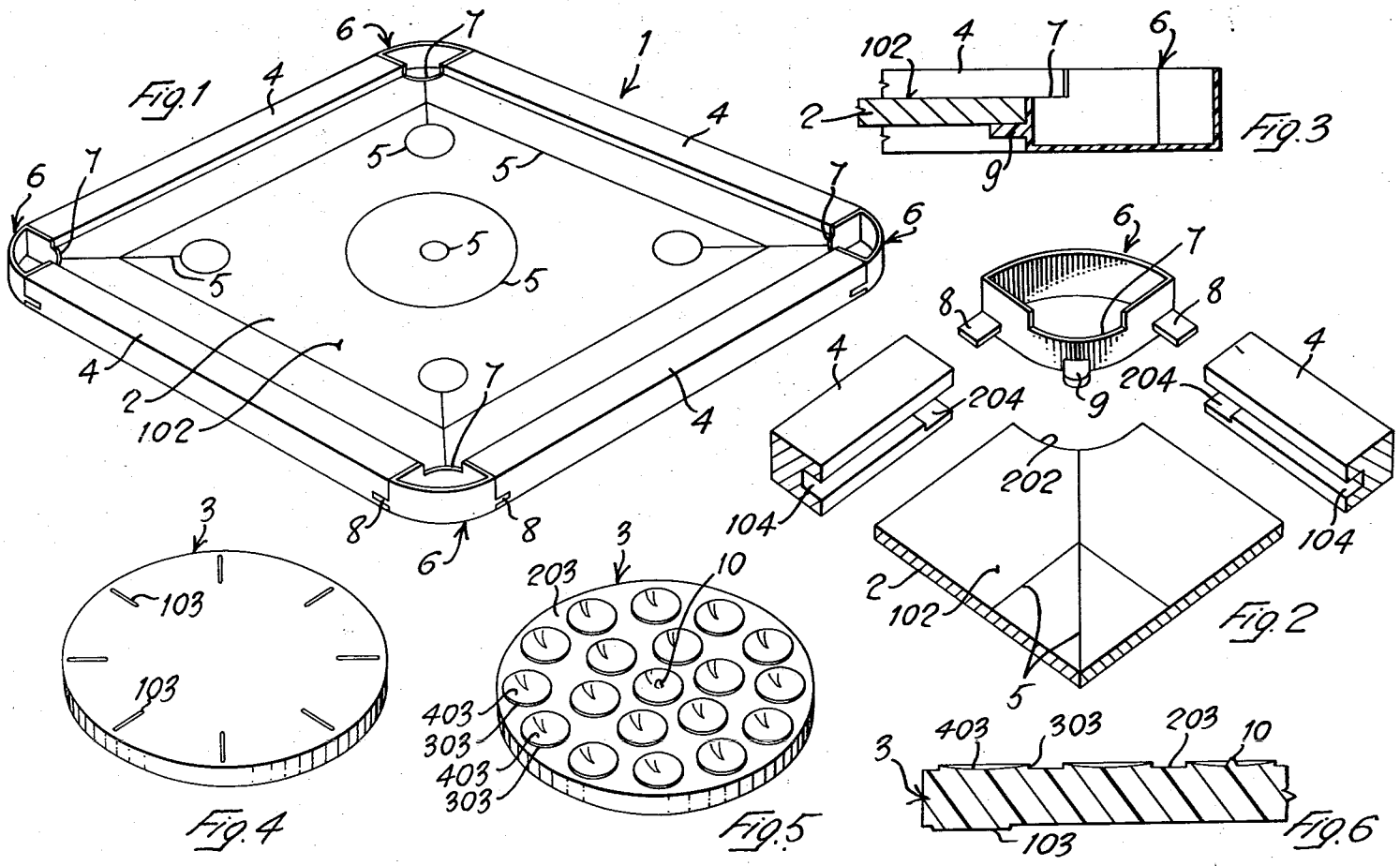
FIG. 1 is a perspective view of the playing area of the table game according to the invention.
FIG. 2 is a perspective exploded view of a detail drawing of a corner zone of the playing area.
FIG. 3 is a vertical section taken along a diagonal, of a corner zone of the playing area.
FIG. 4 is a perspective view, from the top, of a disk of the current invention.
FIG. 5 is a perspective view, from the bottom, of a disk of the current invention.
FIG. 6 is a vertical section of a detail of a disk.

With reference to the Figures, the table game of the present invention comprises a table 1, presenting a square flat playing area or field 2 to which there can slide the small disks 3, which are impelled by any suitable impelling means, so as to slide, as above mentioned, on the area 2 and strike and rebound against one another and against the four ledges or rails 4 which delimit the playing area 2. The impelling means can be of any type, such as cues, maces, manual throwing or finger striking of the disks. The playing area will present suitable markings 5 (such as lines, circles, spots) which depend on the type of game being played. In order to protect the said markings 5 and prevent their cancellation by the wear due to the disks 3 sliding on the playing area, the sliding surface 102 of said playing area 2 is coated 2 with smooth, hard, transparent plastic material, said plastic coating being obtained by means of any suitable known process. The plastic material for coating is chosen among plastics presenting a low friction coefficient, so as to favour the sliding of the disks on the sliding surface 102.

The ledges 4, which constitute the rails or cushions of the playing area 2, are provided with inner longitudinal grooves 104 inside which there are tightly fitted the corresponding edges of the board of which the playing area 2 is made.

In the corners of the playing surface 2, there are arranged the pockets 6, which are intended to receive the disks 3 through the openings 7. Each pocket consists of an open-top box, preferably made of plastic material, presenting in plan, view the shape of a rectangular circular sector, provided with side tongues 8 for fitting into end portions 204 of the grooves 104 obtained in the ledges 4. Each pocket 6 is, moreover, provided with a supporting tongue 9, centrally with respect to a rounded portion below the opening 7, said tongue 9 supporting the playing surface 2 in correspondence of its inwardly rounded corner 202.

Referring now particularly to FIG. 4, each disk 3, is preferably made of hard plastic material presenting a low friction coefficient, is constructed as a flat circular small plate and presents on its top side (i.e. the side which does not contact the sliding surface 102 of the playing area 2) a crown of radial markings 103, which are diametrally opposed, two by two, and serve for the player to take the aim at the moment of hitting the disk.

On its bottom side (i.e. the side which contacts the sliding surface 102 of the playing area 2) each disk 3 presents, as it appears clearly from FIGS. 5 and 6, a plurality of small circular projections 303 which are orderly arranged, projecting from the bottom surface 203. Each small projection 303 presents a concave imprint 403 so that, when the disk 3 is contacting the sliding surface 102, all the concavities 403 of the projections 303 will be directed downwardly. It appears evident therefore that practically the actual contact between the bottom side of the disk and the sliding surface 102 is established by the circular edges of the concave imprints 403 of the projections 303. By this arrangement, it has been found that the friction of the disks 3 moving on the sliding surface 102 is greatly reduced, and therefore the said disks 3 will slide more quickly and easily with lesser consumption of both the disks and of the sliding surface.

According to still another characteristic of the invention, it has been found that the friction between the disk 3 and the sliding surface 102 can be further reduced, by providing, in a projection 303 which is located at the center of the disk, a point 10 which is arranged centrally with respect to the said projection, substantially coinciding with the mentioned center of the disk, and which projects slightly beyond the plane defined by the circular edge of the concavity 403.

Of course, numerous changes and modifications are possible. Thus, for example, the playing surface 2 may be rectangular, or even circular, depending on the game which is played. Also, there can be provided a disk presenting a smaller diameter than the other disks and serving as object ball or jack in a billards or bowl game, or as ball in a football or soccerball game. Further, each disk 3 may present a plurality of points 10, arranged in some of the concavities 403 of its bottom surface.

It is believed that the invention will have been clearly understood from the foregoing detailed description of a preferred embodiment. Changes in the details of construction, as above mentioned, may be resorted to without departing from the spirit of the invention, and it is accordingly intended that no limitation be implied and that the hereto annexed claims be given the broadest interpretation to which the employed language fairly admits.

We claim:

1. In a game played on a substantially flat playing surface, at least one disk capable of sliding on said surface, said disk having on the side contacting said playing surface a plurality of small circular projections each terminating with a concave imprint having a circular edge directed towards the playing surface, one of said concave imprints being located at the approximate center of said disk and having a point means projecting beyond the plane defined by the circular edge of said one concave imprint to contact said playing surface.

2. A game according to claim 1, wherein there is a plurality of disks, each being identical to said disk and presents on it side not contacting with the sliding surface of the playing surface, a plurality of marking means diametrally opposed two by two, for aiming said disk at the moment of impelling the disk.

3. A game according to claim 1, in which said playing surface presents markings, which are particular to a determined game, the said surface being covered by a coating constituting the sliding surface for the disks.

* * * * *